US005967881A

United States Patent [19]

Tucker

[11] Patent Number: 5,967,881

[45] Date of Patent: Oct. 19, 1999

[54] CHEMICAL MECHANICAL PLANARIZATION TOOL HAVING A LINEAR POLISHING ROLLER

[76] Inventor: Thomas N. Tucker, 3111 S. Pennington Dr., Chandler, Ariz. 85248

[21] Appl. No.: 08/865,606

[22] Filed: May 29, 1997

[51] Int. Cl.[6] ..... B24B 1/00

[52] U.S. Cl. ..... 451/41; 451/6; 451/288; 451/60; 451/63; 451/446; 451/289

[58] Field of Search ..... 451/6, 41, 285–289, 451/60, 446, 37, 57, 63

[56] References Cited

U.S. PATENT DOCUMENTS

| | | | |
|---|---|---|---|
| 3,583,110 | 6/1971 | Scott . | |
| 4,728,552 | 3/1988 | Jensen, Jr. . | |
| 4,805,348 | 2/1989 | Arai et al. . | |
| 4,811,522 | 3/1989 | Gill . | |
| 5,036,625 | 8/1991 | Gosis . | |
| 5,083,401 | 1/1992 | Yamashita et al. . | |
| 5,099,614 | 3/1992 | Arai et al. . | |
| 5,128,281 | 7/1992 | Dyer et al. | 451/63 |
| 5,203,067 | 4/1993 | DeFazio | 451/182 |
| 5,245,790 | 9/1993 | Jerbic . | |
| 5,245,796 | 9/1993 | Miller et al. | 451/41 |
| 5,329,732 | 7/1994 | Karlsrud et al. . | |
| 5,476,414 | 12/1995 | Hirose et al. . | |
| 5,498,196 | 3/1996 | Karlsrud et al. . | |
| 5,498,199 | 3/1996 | Karlsrud et al. . | |
| 5,558,568 | 9/1996 | Talieh et al. . | |
| 5,575,706 | 11/1996 | Tsai et al. | 451/41 |
| 5,584,751 | 12/1996 | Kobayashi et al. | 451/41 |
| 5,605,488 | 2/1997 | Ohashi et al. | 451/41 |
| 5,643,056 | 7/1997 | Hirose et al. . | |
| 5,700,179 | 12/1997 | Hasegawa et al. | 451/41 |
| 5,707,274 | 1/1998 | Kim et al. | 451/290 |
| 5,733,175 | 3/1998 | Leach . | |
| 5,735,731 | 4/1998 | Lee . | |
| 5,769,696 | 6/1998 | Lee et al. | 451/41 |

FOREIGN PATENT DOCUMENTS

| | | | |
|---|---|---|---|
| 0 362 516 | 4/1990 | European Pat. Off. . | |
| 302 516 | 4/1990 | European Pat. Off. . | |
| 0 677 867 | 10/1995 | European Pat. Off. . | |
| 0 764 478 | 3/1997 | European Pat. Off. . | |
| 195 40 626 | 3/1988 | Germany . | |
| 361297073 | 12/1986 | Japan | 451/63 |
| 261 227 | 11/1926 | United Kingdom . | |

OTHER PUBLICATIONS

Patent Abstracts of Japan—vol. 007, No. 047 (M–196), Feb. 24, 1983 and JP 57 194866 (Shinetsu Kagaku Kogyo KK), Nov. 30, 1982.

Patent Abstracts of Japan—vol. 015, No. 028 (M–1072), Jan. 23, 1991 and JP 02 269552 (Rodeele Nitta KK;Other: 01), Nov. 2, 1990.

*Primary Examiner*—Robert A. Rose
*Assistant Examiner*—George Nguyen
*Attorney, Agent, or Firm*—Snell & Wilmer

[57] ABSTRACT

A tool is provided for polishing, planarizing, cleaning or otherwise processing silicon wafers or other workpieces. It comprises a cylindrical roller mounted on a spindle above a platform or workstation on which a wafer is mounted. The roller is movable into and out of contact with the wafer, and is rotatable to polish the wafer. The wafer may also be rotatable and translatable on the platform. The roller has a linear region of contact with the wafer during processing operations.

15 Claims, 9 Drawing Sheets

CHEMICAL MECHANICAL PLANARIZATION TOOL HAVING A LINEAR POLISHING ROLLER

TECHNICAL FIELD OF THE INVENTION

The present invention relates generally to tools for polishing or planarizing workpieces such as silicon wafers and, more particularly, relates to a tool for polishing or planarizing workpieces using a linear cylindrical polishing roller.

BACKGROUND OF THE INVENTION

Many electronic and computer-related products such as semiconductors, hard disks and CD-ROMS require highly polished or planarized surfaces in order to achieve optimum performance. In the semiconductor manufacturing industry, for example, silicon workpieces are used in the manufacture of integrated circuit components and the like. The workpieces are known in the industry as "wafers" and typically have a flat, circular disk-like shape. The wafers are initially sliced from a silicon ingot and, thereafter, undergo multiple masking, etching, and dielectric and conductor deposition processes to create microelectronic structures and circuitry on the wafers. The surface of a wafer undergoing these processes typically must be polished or planarized between processing steps to ensure proper flatness, permitting use of photolithographic processes for building additional dielectric and metallization layers on the wafer surface.

Chemical Mechanical Planarization (CMP) machines have been developed to polish or planarize silicon wafer surfaces to the flat condition necessary for manufacture of integrated circuit components and the like. CMP processes and machines are known in the art and are described in several U.S. Patents. Examples include U.S. Pat. No. 4,805,348, issued in February 1989, to Arai, et al.; U.S. Pat. No. 4,811,522, issued in March 1989 to Gill; U.S. Pat. No. 5,099,614, issued in March, 1992 to Arai et al.; U.S. Pat. No. 5,329,732, issued in July, 1994 to Karlsrud et al.; U.S. Pat. No. 5,476,414, issued in December 1995 to Masayoshi et al.; U.S. Pat. Nos. 5,498,196 and 5,498,199, both issued in March, 1996 to Karlsrud et al; and U.S. Pat. No. 5,558,568, issued in September 1996 to Talieh et al.

Known CMP machines and processes typically utilize a wafer carrier or transport apparatus which is positioned above a polishing pad and configured to receive and hold one or more wafers. Typically, the carrier apparatus has multiple heads for holding multiple wafers. In operation, the carrier apparatus is lowered such that the wafers held by the carrier apparatus are pressed against the polishing pad while the polishing pad is rotated about its vertical axis. The wafers may also be rotated about their vertical axes and oscillated radically back and forth over the pad surface to improve polishing effectiveness.

Prior art CMP machines of this sort, while adequate in most respects, do have several drawbacks. The machines are characteristically quite bully and have a sizable "footprint". By this, it is meant that the machines occupy a significant amount of plant floorspace, which is usually limited and expensive. In addition, because the machines have a large footprint, they also are massive and of great weight, increasing the loading on the floor. Another shortcoming of known CMP machines is a difficulty in achieving uniform pressure distribution across the surface of the wafer as it is pressed against the polishing pad. Attaining a uniform pressure distribution is important in that it fosters consistent and uniform polishing across the entire wafer surface. The difficulty in achieving uniform pressure distribution arises from the fact that the entire surface of the wafer is in contact with the polishing pad during polishing operations. Another drawback, arising from the conventional "face down" position that a wafer is held in during polishing, is the difficulty of visually or otherwise monitoring the polishing process for consistency and uniformity.

SUMMARY OF THE INVENTION

The present invention provides a novel polishing and planarizing tool which addresses and resolves the shortcomings of the prior art described above, and also provides additional advantages over known CMP machines.

In accordance with the present invention, a tool is provided for planarizing or polishing a workpiece. The tool comprises a cylindrical roller that is contactable with a surface of the workpiece and is rotatable to planarize or polish the workpiece surface.

In a preferred embodiment of the present invention, the tool is utilized for polishing semiconductor wafers. The cylindrical roller is mounted above a support platform which supports the wafer. The roller is vertically movable to bear against a surface of the wafer in a linear region of engagement, and is rotatable to polish a surface of the wafer. The tool also comprises a mechanism for horizontally translating the wafer underneath the roller.

In a method according to the present invention, a rotatable roller is mounted such that it is movable to bear against a surface of a workpiece. The roller is moved such that it bears against the surface of the workpiece and is rotated such that it polishes or planarizes the workpiece surface. As the wafer surface is being polished or planarized by the roller, the workpiece is translated back and forth.

These and other aspects of the present invention are described in more detail in the following description, attached drawing figures and claims.

BRIEF DESCRIPTION OF THE DRAWING FIGURES

DETAILED DESCRIPTION OF PREFERRED EMBODIMENTS OF THE INVENTION

Figure 1:
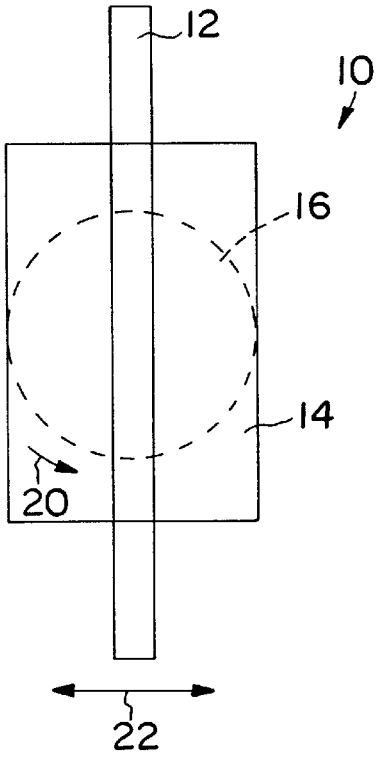
FIG. 1 is a top plan view of a linear polishing roller embodying the present invention.

A linear polishing tool 10 according to the present invention is illustrated in FIG. 1. Tool 10 would typically be used in environments where CMP machines are now used to polish and process wafers. In this regard, tool 10 could be incorporated into an existing CMP machine design, or it could be the centerpiece of an entirely new CMP machine. It should also be appreciated that tool 10 could be used in conjunction with other machines or operations wherein polishing, cleaning or otherwise processing a workpiece is necessary or desired.

Tool 10 comprises a central spindle 12 on which is mounted a cylindrical polishing roller 14. Spindle 12 and roller 14 are fixed for relative movement such that rotation of spindle 12 effects simultaneous rotation of roller 14. Spindle 12 is preferably rotatably mounted above a platform or work area of a CMP or other machine where wafers or other workpieces are to be processed. An exemplary wafer 16 is illustrated in phantom lines below tool 10. Tool 10 is downwardly movable to contact wafer 16 and upwardly movable away from wafer 16. Preferably, tool 10 is also pivotable into and out of operative position to facilitate easier access to tool 10 for maintenance and servicing.

Alternatively, and depending on the processing environment in which tool 10 is deployed, the positions of tool 10 and wafer 16 relative to each other could be modified. Tool 10 could be mounted underneath wafer 16, for example, or wafer 16 and tool 10 might be mounted in a side-to-side relationship. For descriptive purposes it is assumed in the following text that tool 10 is mounted above wafer 16.

Tool 10 polishes or otherwise processes wafer 16 using principles of linear kinematics. During polishing, spindle 12 and roller 14 are lowered such that they contact and exert a downward force on wafer 16, and are also rotated in the direction of arrow 18 (FIG. 2) to planarize or polish wafer 16. Wafer 16 may also be spun about its axis by a spindle or other means in the direction of arrow 20 (FIG. 1), translated back and forth in the direction of arrow 22 (FIG. 1), or simultaneously rotated and translated. Typically, a slurry solution 24 will be injected between wafer 16 and roller 14 by a slurry tube 26 or other delivery mechanism to aid in the polishing process.

Figure 3:
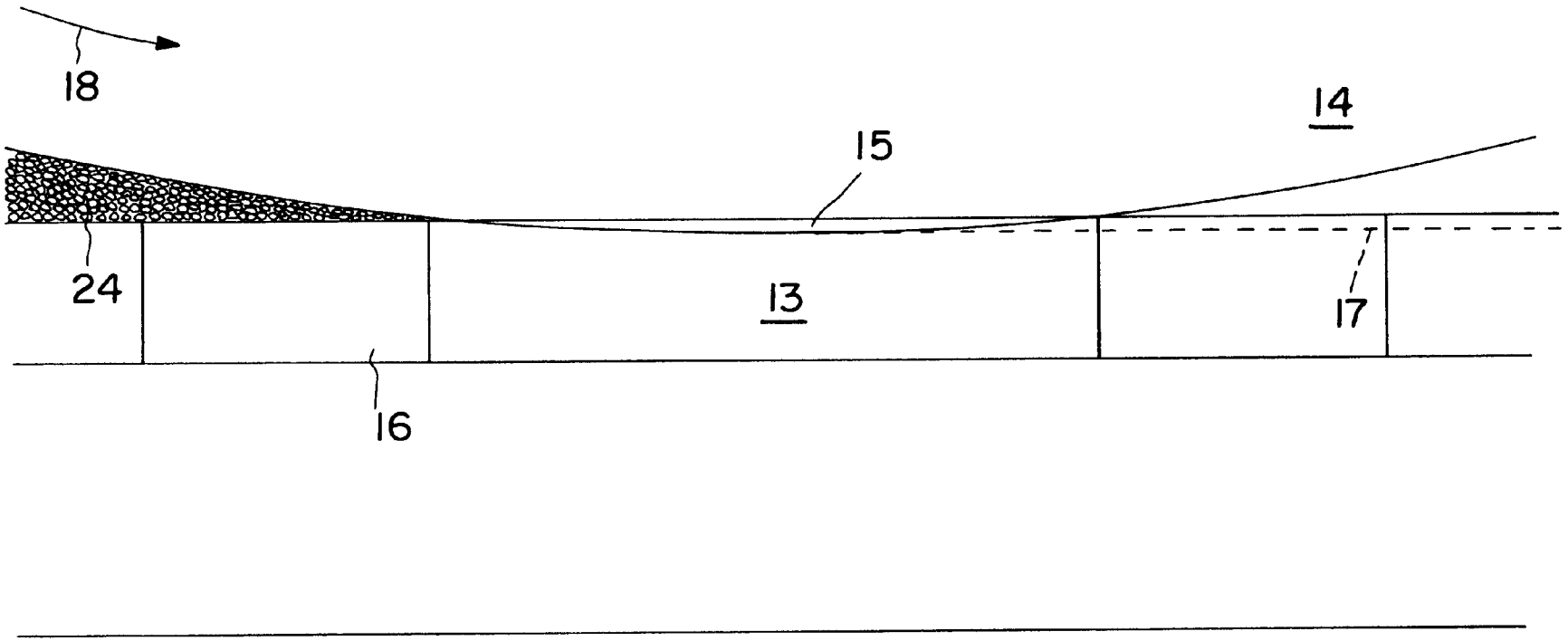
FIG. 3 is an exploded side view of the polishing process of FIG. 2.

FIG. 3 affords a detailed view of the area of engagement between roller 14 and wafer 16 during polishing. Roller 14 bears against wafer 16 along a linear region 13, causing removal of material from area 15. As roller 14 progresses across the surface of wafer 16, a polished or planarized surface is formed as indicated by phantom line 17. Since the area of contact between roller 14 and wafer 16 is essentially linear, rather than spread out across the entire surface of the wafer, an exertion of relatively low downforce by roller apparatus 10 leads to uniform and highly localized pressures. The highly localized pressures are useful for attaining more effective removal rates and thus, more uniformly polished and/or planarized wafer surfaces. This is in contrast to conventional CMP machines, wherein the entire surface of the wafer is in contact with a polishing pad during polishing, making it much more difficult to attain a uniform pressure distribution across the wafer.

Roller 14 may be constructed of any suitable polishing material. In the context of processing silicon wafers, polyurethane is preferably used and is cast in a cylindrical shape with a central shaft for receiving a spindle. The cast polyurethane cylinder may thereafter be machined as necessary on a lathe. The density, diameter, molecular weight and polymer length of the roller material may be varied as the application requires. For planarization applications, a relatively hard roller material is preferred. The feedstock used for manufacturing Rodel IC 1000 pads, which is currently the defacto industry standard material for planarization, is a suitable starter material for roller 14.

Roller 14 may have a relatively thick cross section (in the range of eight inches), which is advantageous from a consumable standpoint. Polishing pads used in conventional CMP machines have a much thinner cross section and, consequently, wear out faster and must be replaced more often. A thicker roller, as described herein, has a longer life and requires less down time for replacement or other maintenance. Alternatively, roller 14 may be constructed with a thinner cross section and be mounted over a metal mandrel. This configuration is advantageous in that the metal mandrel could be heated, for example, with fluid or the like to increase the process temperature. As will be described in more detail below, a thin polishing pad may also be employed to generate electric polarization during polishing.

Figure 2:
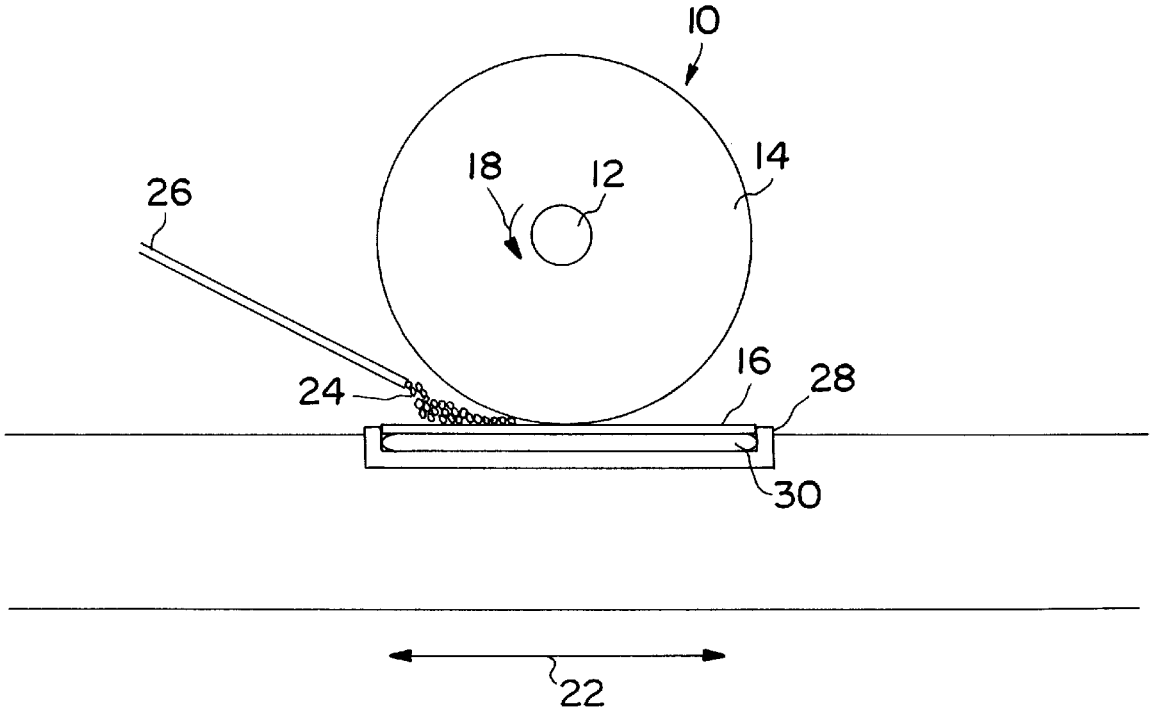
FIG. 2 is a side view of the linear polishing roller of FIG. 1 as it polishes an exemplary wafer.

Still referring to FIG. 2, wafer 16 may be carried on a belt, a movable table or any other appropriate transport mechanism which causes the wafer to translate back and forth in the direction of arrow 22. The wafer may be mounted in a suitable vacuum chuck or carrier mechanism such as a retaining ring 28. A gas or fluid filled bladder 30 may also be positioned within retaining ring 28 underneath wafer 16. Bladder 30 provides a uniform distribution of hydrostatic pressure underneath the wafer which, in turn, promotes consistent and uniform planarization.

Provision of hydrostatic pressure is particularly useful when processing wafers or workpieces having wedge-shaped edges. Without application of hydrostatic pressure, the polishing roller would exert full pressure across the central portion of the wafer but less pressure at the wedge-shaped edges which, due to their wedged shape, are spaced from the roller. Application of hydrostatic pressure tends to "push" the wedged areas up and present a flat surface to the roller, thereby yielding a more uniformly polished surface. Alternatively, inflatable bladders can be used to control the downforce applied to the wafer. If a roller having a relatively thin cross-section is used, the airspace inside the roller could be pressurized to yield a uniform distribution of hydrostatic pressure.

Several configurations and methods may be employed to further enhance the uniform polishing and planarization provided by the linear roller. The wafers may be passed several times underneath the roller. Moreover, between roller passes, the wafer may be rotated a discrete, predetermined amount in order to achieve uniformity. The discrete rotations of the wafer should total an integral number of total revolutions. If ten passes are to be made, for example, and the wafer is to be discretely rotated between each pass, a rotation of thirty-six degrees (36°) between each pass would yield a total rotation of one revolution. Alternatively, the wafer might be continuously rotated at higher speeds while being polished. Continuous and higher speed rotation of the wafer minimizes the potential for nonuniform removal resulting from of a nonintegral number of wafer rotations. If the wafer is only rotated in this manner and not translated, however, an integral number of wafer revolutions should be performed to avoid creation of a nonuniform removal pattern or "butterfly" effect.

If wafers are continuously rotated during polishing, one half of the wafer will essentially be moving in the same direction as the direction of movement of the roller, while the other half of the wafer will be moving in a direction which opposes the direction of movement of the roller. Consequently, the velocity vector of one half of the wafer will add to the velocity vector of the roller and tend to increase overall velocity, while the velocity vector of the other half of the wafer will subtract from the velocity vector of the roller and tend to decrease overall velocity. The resultant "push" on one half of the wafer and "drag" on the other side of the wafer may give rise to a nonuniform removal pattern.

This problem is addressed by setting the rotation velocity of the roller much higher than the rotation velocity of the wafer. In this manner, the velocity vector added or subtracted to the roller rotation due to wafer rotation will be inconsequential as compared to the overall much higher rate of rotation of the roller. During polishing, for example, roller 14 is preferably rotated at a speed in the range of about 250 revolutions per minute while wafers should be rotated at speeds no higher than about ten revolutions per minute. A roller rotated at this speed and having a diameter of eight inches, and therefore a circumference of approximately two feet, would have a surface speed of 250 revolutions/minute×2 feet/revolution=500 feet/minute.

Another factor effecting polishing uniformity is the inherent effect that the circular shape of the wafer has as it is translated underneath the polishing roller. Since the wafer is circular, the "length" of the region of linear contact between the wafer and roller will continually change as the wafer diameter exposed to the roller increases or decreases. Accordingly, if a constant downward roller force is applied, the result will be a constantly varying amount of effective downforce per square centimeter (or other unit) of wafer surface. To compensate for this problem, the amount of downforce applied to the wafer could be continually adjusted as necessary to yield a constant downforce per square centimeter (or other unit) of wafer surface. Tool 10 may be preprogrammed to automatically effect this adjustment.

Tool 10 has a very small footprint, that is, it occupies a very small amount of space in the plant or facility at which it is located. As one skilled in the art knows, footprint size is a critical factor in semiconductor manufacturing, as well as in other industries, due to the high cost of plant and industrial workspace. The present invention permits use of a polishing roller comparable in size to the size of the wafer being polished. A roller having a diameter of eight inches, for example, could be used to polish wafers having diameters of eight inches. This is an enormous size reduction as compared to conventional CMP machines, which often utilize complex and bulky overhead carrier mechanisms and precision robotics to move wafers into contact with large diameter polishing pads and through other processing stations.

Figure 4:
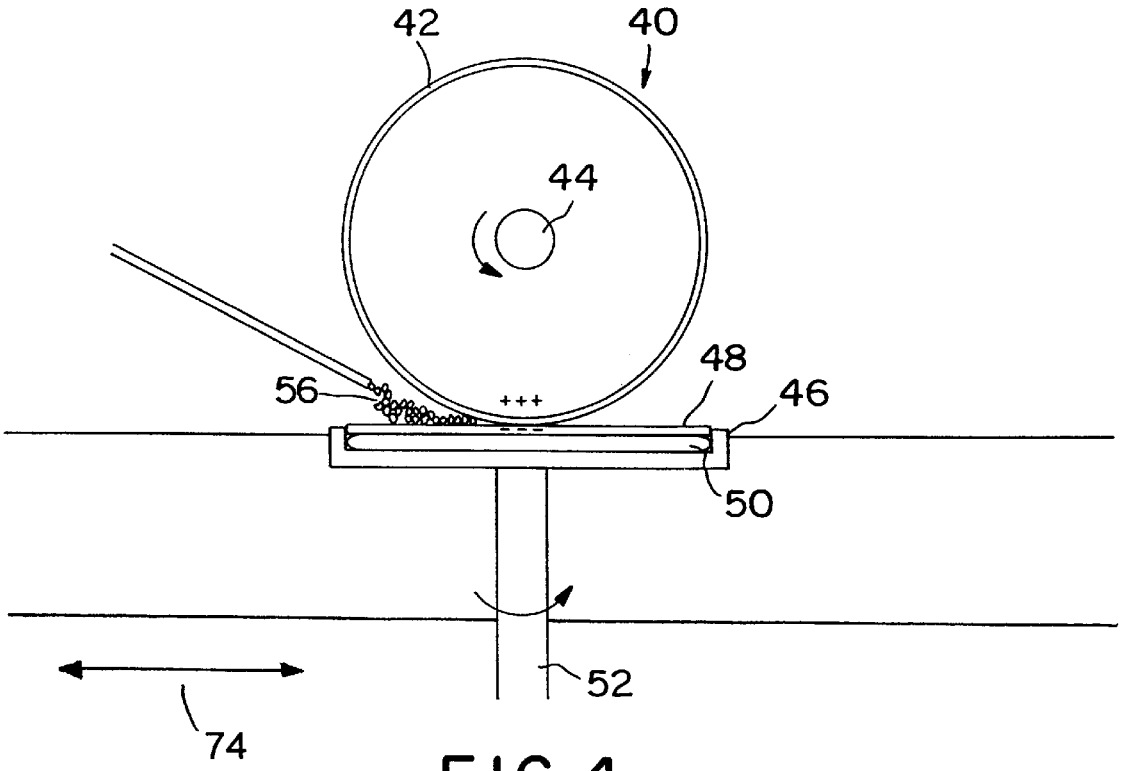
FIG. 4 is a side view of a polarizing linear polishing roller embodiment as it polishes an exemplary wafer.

Another embodiment of the present invention is illustrated in FIG. 4. Roller tool 40 utilizes a thin, cylindrical roller pad 42 mounted around a central spindle 44. Tool 40 is mounted above retaining ring 46 which holds a wafer 48 supported by a gas or fluid filled bladder 50. Retaining ring 46 is rotatable about its axis by virtue of spindle 52, and a slurry delivery tube 54 injects slurry 56 between the roller and wafer during polishing.

The thin pad configuration of roller 42 is useful for generating electric polarization fields during polishing. To engender such polarization, a thin metal film or conductor is embedded between layers of the polishing pad, and a thin metal film is disposed underneath the wafer (not shown). Since polishing is an electrochemical process, the presence of electrical fields created by such polarization can enhance or retard polishing rates. When polarization is employed, the slurry chemistry must be carefully controlled to prevent problems associated with enhanced removal of barrier layers and/or adhesion layers from the wafer. If desired, actual current flow can be effected by using a perforated polishing pad or a pad having micropores.

Figure 5:
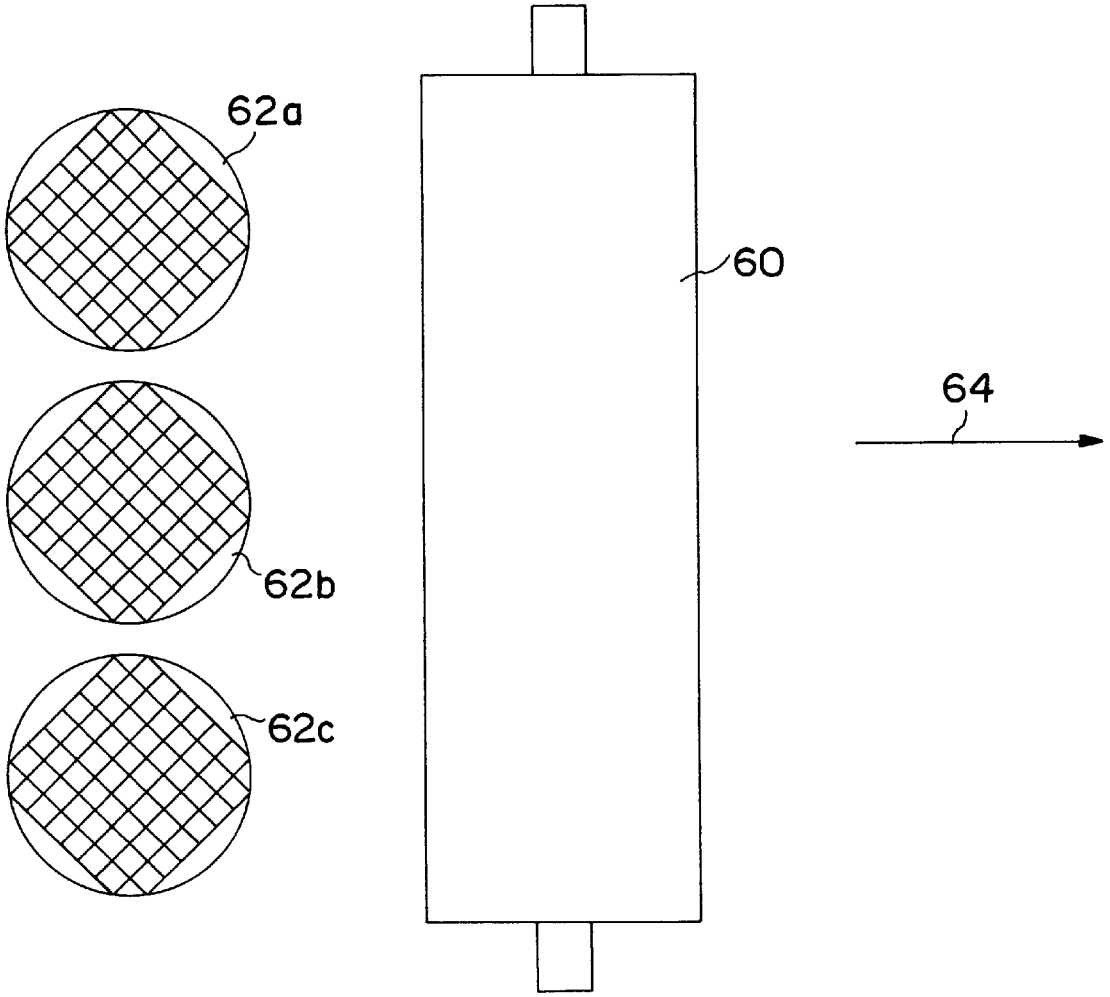
FIG. 5 is a top plan view of another linear polishing roller embodiment useful for polishing multiple wafers simultaneously.

A roller useful for polishing several wafers simultaneously is illustrated in FIG. 5. Polishing roller 60 has a length sufficient to allow simultaneous polishing of multiple wafers 62*a*, 62*b* and 62*c*. The wafers are translated under roller 60 in the direction of arrow 64. Three wafers are illustrated, but roller 60 could be of a length sufficient to simultaneously polish any desired number of wafers.

Figure 6:
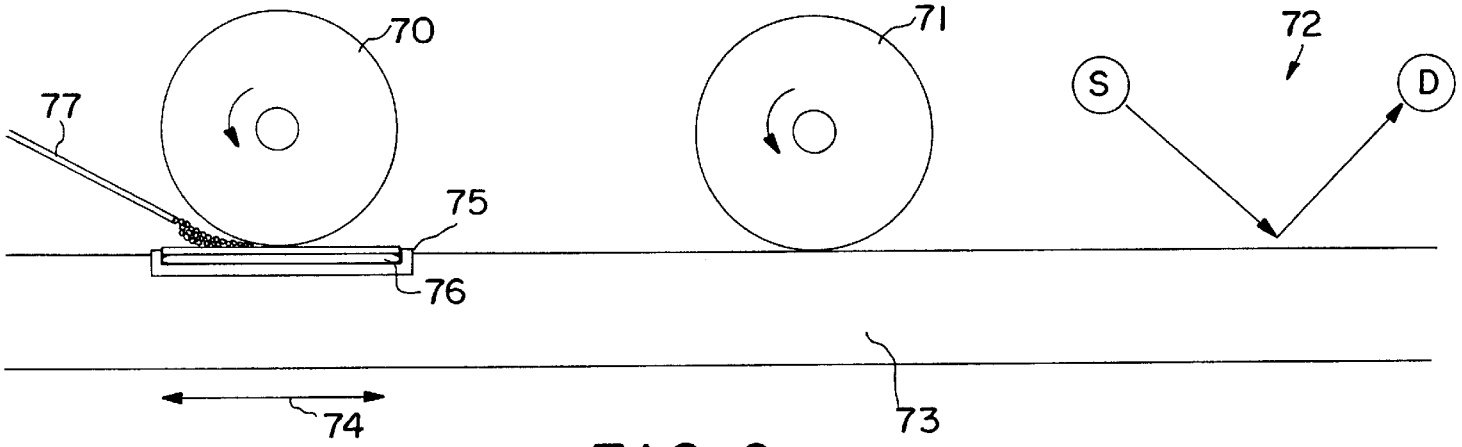
FIG. 6 is a side view of another embodiment of the present invention which utilizes multiple rollers, depicting a wafer in a polish position.
Figure 7:
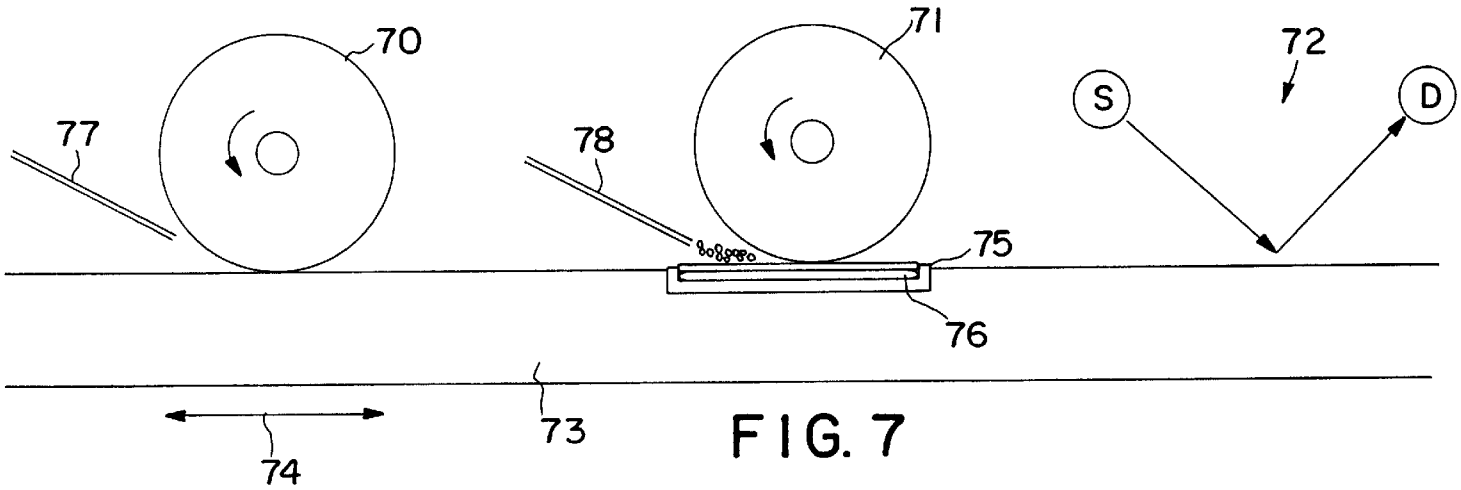
FIG. 7 is a side view of the embodiment of FIG. 6, depicting the wafer in a cleaning position.
Figure 8:
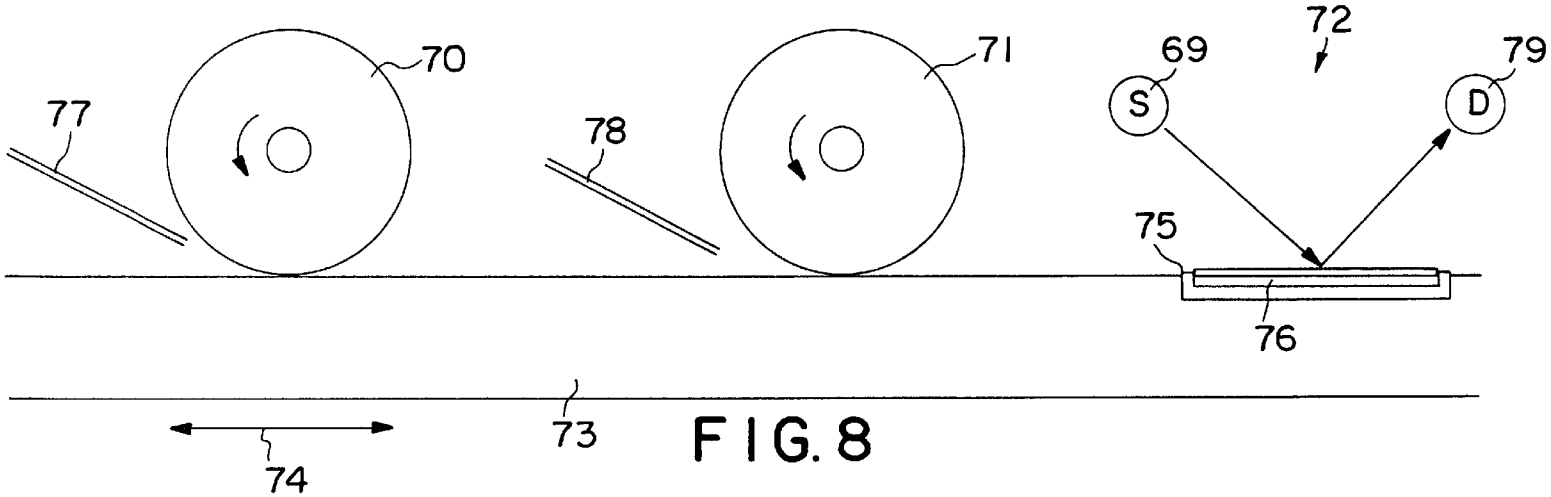
FIG. 8 is a side view of the embodiment of FIGS. 6 and 7, depicting the wafer in a metrology position.

As depicted in FIGS. 6–8, a plurality of rollers may be arranged in sequence, with each roller occupying a position and performing a distinct processing operation on wafers as they are translated underneath the rollers. FIG. 6 depicts a polishing or planarization roller 70, a cleaning roller 71 and a metrology station 72 arranged sequentially above a translation belt or table 73. Belt 73 is movable back and forth underneath the rollers in the direction of arrow 74. Retaining ring 75 is attached to belt 73 and secures a wafer 76 for movement in the direction of arrow 74. In FIG. 6, wafer 76 is at a polishing/planarization position underneath roller 70. Slurry tube or delivery mechanism 77 introduces slurry between wafer 76 and roller 70 during polishing. When planarization/polishing is complete, belt 73 moves wafer 76 forward to a cleaning position underneath roller 71 (FIG. 7). During cleaning, a tube or delivery mechanism 78 may introduce a cleaning solution between wafer 76 and roller 71.

Since wafers are preferably processed "face up" as shown in FIGS. 6–8, the present invention lends itself to in situ measurements and observations of film thickness and uniformity or wafer status. As contact between roller and wafer takes place along a narrow, linear band, most of the wafer face is exposed, even during polishing, and is easily visually observed and monitored. This is in contrast to conventional CMP systems, where wafers are typically encaptured within a carrier mechanism and lowered face down into contact with a polishing pad and, consequently, are not easily observable or accessible for monitoring.

If desired, instrumentation or sensors can be utilized to generate more precise measurements of film thickness and/or uniformity. This is the purpose of metrology station 72. Wafer 76 may be moved forward from cleaning roller 71 to metrology station 72. Metrology station 72 may generate measurements of film thickness and/or uniformity through the use of, for example, an emitter 69 and detector 79. Other appropriate measurement or detection devices could be utilized. Depending on the results of the measurements taken at station 72, the wafer could be returned to station 70 for additional polishing.

Since belt 73 is bidirectionally movable in the direction of arrow 74, wafers may be oscillated forwardly and rearwardly as many times as is necessary between polishing roller 70 and metrology station 72 until a suitably finished condition is detected. One station (not shown) may be utilized both for loading and unloading wafers onto belt 73 for processing. Conventional CMP systems, by contrast, require separate loading and unloading stations, as well as complex mechanisms for moving wafers between processing stations. The sequential processing configuration of FIGS. 6–8 may be used to process wafers individually, or may be used in combination with a configuration such as that shown in FIG. 5 to permit sequential processing of multiple wafers.

Figure 9:
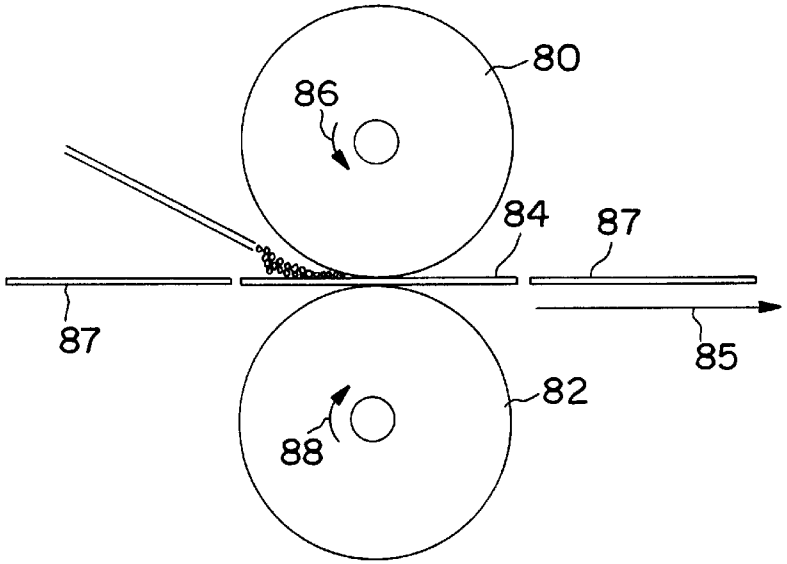
FIG. 9 is a side view of another embodiment of the present invention which utilizes top and bottom rollers.

FIG. 9 illustrates another embodiment of the present invention in which two rollers 80 and 82 are utilized. Roller 80 is a polishing roller positioned above wafer 84 and rotates in a counterclockwise direction (arrow 86). Roller 82, which rotates in a clockwise direction (arrow 88), does not polish wafer 84 but is a stabilizing roller that provides an equal distribution of forces on the top and bottom of the wafer as it is polished and translated in the direction of arrow 85. A template 87 may be useful in conjunction with this embodiment for stabilizing the wafer(s) until they reach the rollers. Template 87 is preferably fabricated from a flexible, rugged material such as mylar, for example. Again, the embodiment illustrated in FIG. 9 may be used alone or in conjunction with any of the previously described embodiments.

Figure 10:
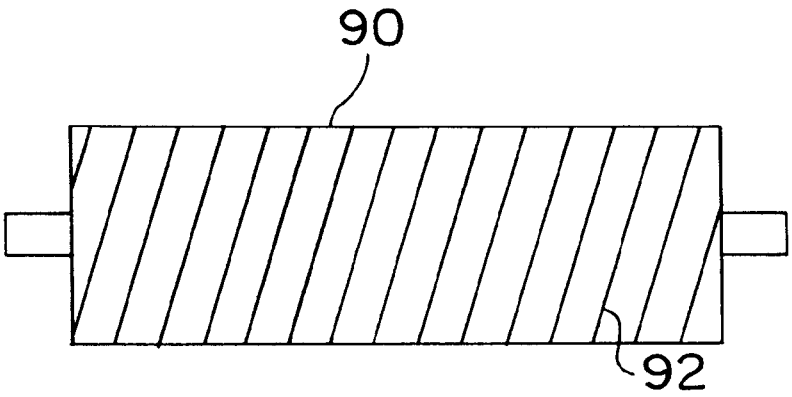
FIG. 10 is a top plan view of another linear polishing roller embodiment having a spiral groove pattern formed therein.
Figure 11:
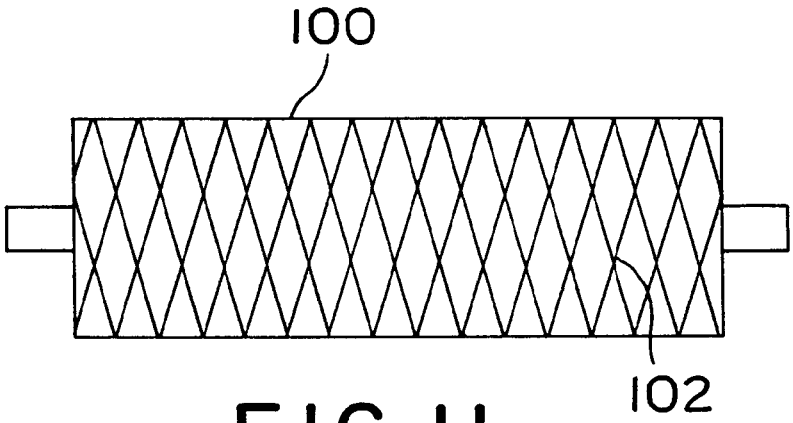
FIG. 11 is a top plan view of another linear polishing roller embodiment having a cross-hatched groove pattern formed therein.
Figure 12:
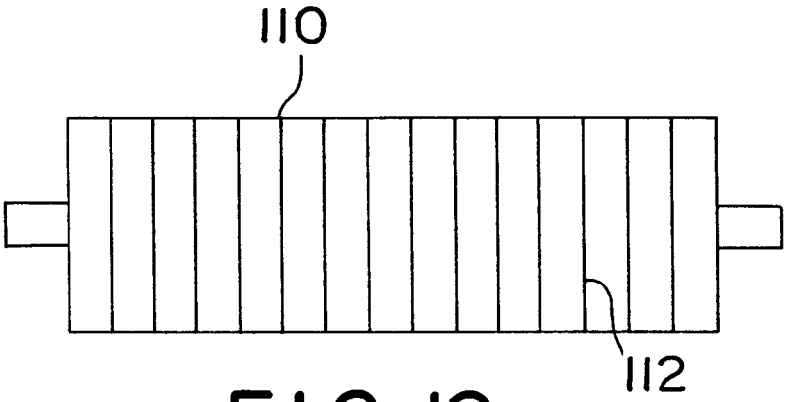
FIG. 12 is a top plan view of another linear polishing roller embodiment having a circular groove pattern formed therein.

To further improve wafer polishing or planarization uniformity, the polishing rollers may be formed with slit or groove patterns cut therein. Several examples of such rollers are depicted in FIGS. 10–12. Roller 90 of FIG. 10 is patterned or cut with a spiral groove 92. Roller 100 of FIG. 11 is formed with a cross-hatched or double-spiral pattern 102. Roller 110 of FIG. 12 has a series of circular grooves 112 formed therein. Other patterns are possible. If the cuts (slits and grooves) are deep enough, the individual pad sections delineated by the grooves will be mechanically decoupled from each other and will act as smaller, individual pad segments on the wafer surface. Each individual segment will act as a separate polishing member.

The advantage of cutting grooves or slits in the rollers is derived from the usual layouts of wafers having microelectronic structures formed on their surfaces. Typically, the components, devices or integrated circuits (collectively referred to as "dies") are arranged on the wafer surface in a checkerboard or grid-like pattern. If grooves are formed on the polishing roller and are spaced apart on the order of the size of an individual die, each decoupled polishing segment will be in contact with only a small number (in the range of 1–4) of individual dies at a time. Hence, if local nonuniformities are present on the wafer surface, only individual segments of the roller will be affected rather than the entire roller surface. The exact pitch, pattern and spacing of the grooves may be varied depending on the die size in question. The pattern used for a 20 mm×20 mm die, for example, would be different from the pattern used for a 10 mm×10 mm die.

Another potential method for enhancing wafer uniformity is the use of ultrasonic motion in combination with the roller action. This is particularly useful in conjunction with the use of slit or grooved rollers. The high frequency, side-to-side motion effected by an ultrasonic source is effective in preventing uneven polishing.

Figure 13:
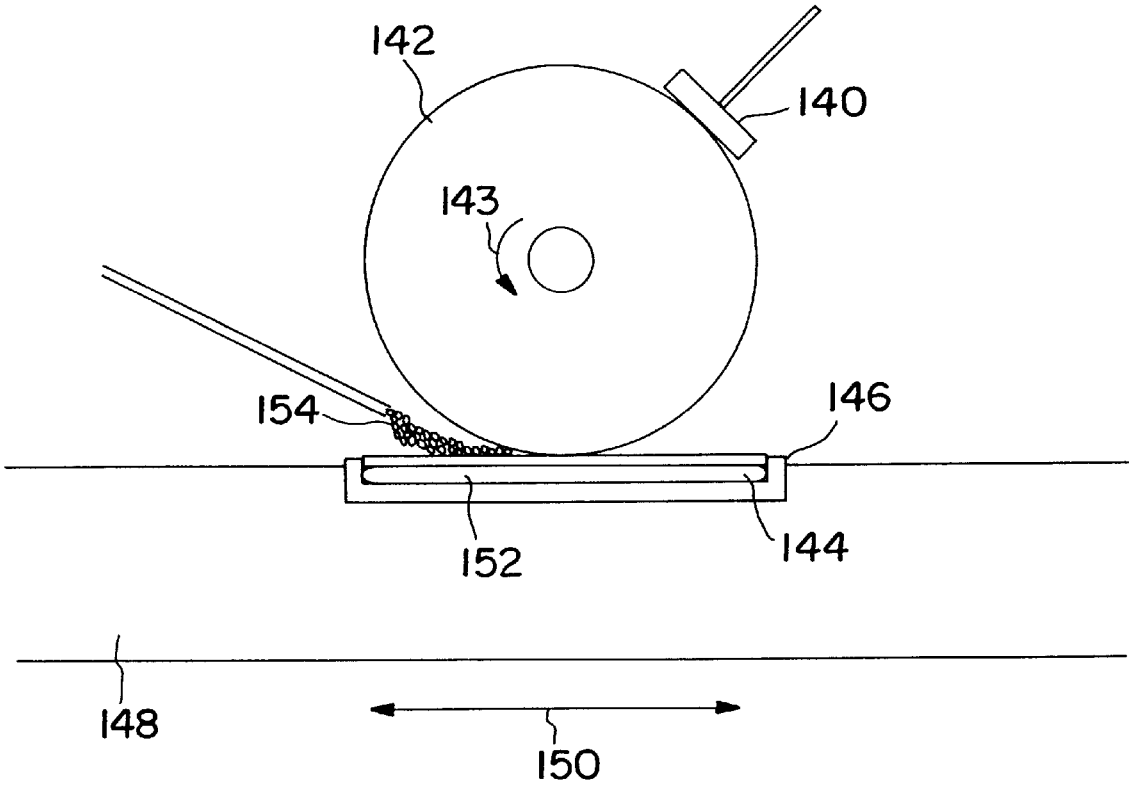
FIG. 13 is a side view of a linear polishing roller according to the present invention wherein a conditioner applicator applies conditioner to a top portion of the roller.

The present invention also permits in situ pad conditioning. Referring now to FIG. 13, a conditioner applicator 140 may be mounted above polishing roller 142 to apply conditioner to the upper portion of roller 142, as it rotates past applicator 140 in the direction of arrow 143, while the lower portion of roller 142 is simultaneously polishing or otherwise processing wafer 144. Again, as discussed previously, wafer 144 may be mounted in a retaining ring 146 attached to a belt 148 which is bidirectionally movable in the direction of arrow 150. Bladder 152 may be positioned between wafer 144 and ring 146 to apply hydrostatic pressure to the undersurface of wafer 144, and slurry may be introduced into the polishing process at 154.

The configuration of FIG. 13 is advantageous in that it is not necessary to halt or delay production while the roller pad is conditioned. By contrast, it is typically necessary to halt operations of conventional CMP machines while the polishing pads are conditioned.

One concern with the roller configurations described herein is the problem of "dishing". Typically, wafers with die patterns have trenches between and separating the individual dies. If a roller were to become precisely aligned with a trench during polishing, the pad roller potentially could follow the trench contour down into the bottom of the trench and penetrate too deeply into the wafer and the die. Experimentation has shown, however, that it is more likely that the interconnecting features and other mechanical support structures distributed across the wafers would act as bridges or stops and essentially preclude dishing or penetration of the roller. Only in the unlikely scenario of trenches traversing the entire surface of the wafer and being precisely aligned with the central axis of the roller during polishing would dishing become a problem. Such an extreme situation is illustrated in FIG. 14, wherein central axis 121 about which polishing roller 120 rotates will be aligned during polishing with trenches 122 which traverse the surface of wafer 124 to define die grid pattern 126.

Figure 14:
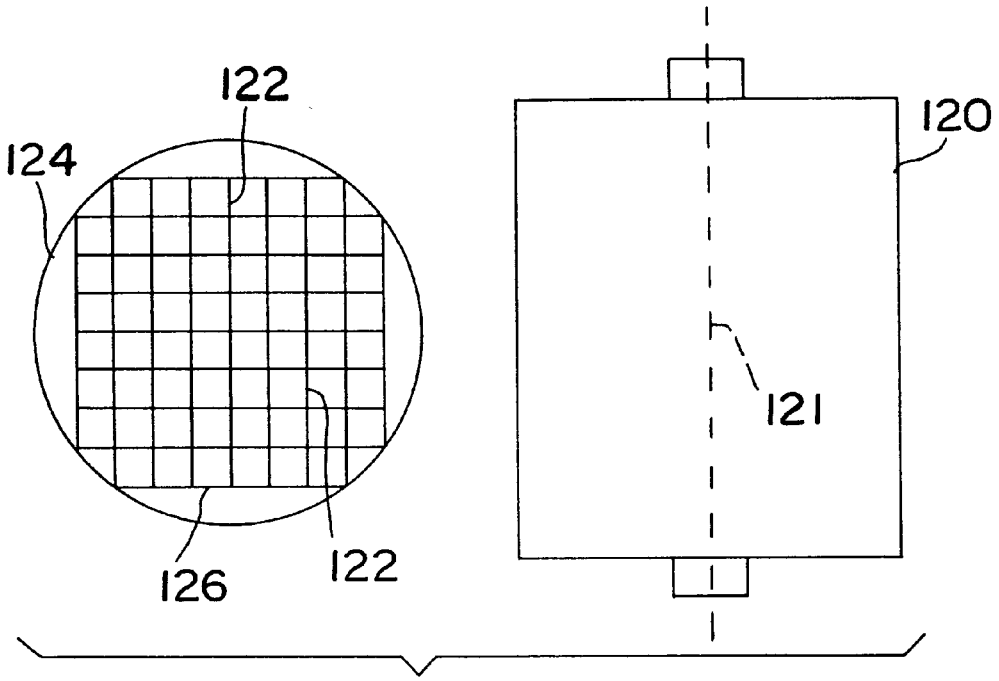
FIG. 14 is a top plan view of a polishing roller and a wafer to be polished which depicts a potential for dishing.
Figure 15:
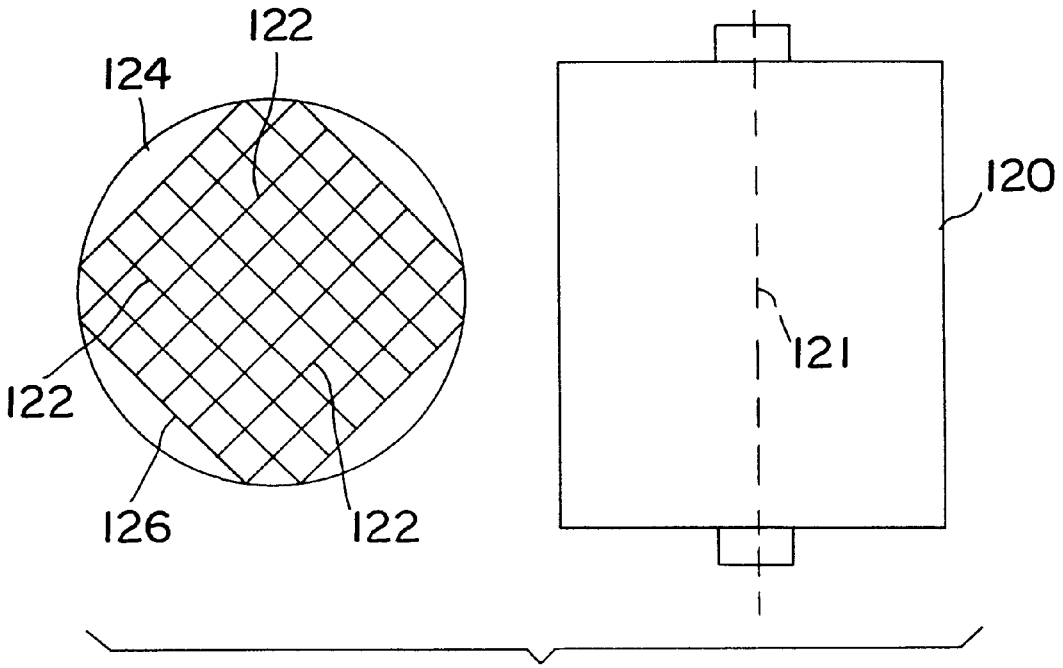
FIG. 15 is a top plan view of a polishing roller and a wafer to be polished which is rotated in a manner to avoid dishing.

The potential for dishing illustrated in FIG. 14 is easily obviated by rotating wafer 124 such that its grid pattern 126 and trenches 122 are at an angle to central axis 121 of roller 120. FIG. 15 depicts wafer 124 rotated in such a fashion so that all trenches 122 are at an angle to the central rotational axis 121 of polishing roller 120. Roller 120 will not become aligned directly above any of the trenches 122 and dishing will not occur.

The present invention has been described with reference to several particular embodiments and drawing figures. It should be realized, however, that the scope of the invention is not limited to these specific embodiments. Although the linear polishing roller of the present invention has been described in the context of polishing and planarizing silicon wafers, for example, it might also be effective in other contexts where processing of workpieces is necessary. Modification may be made to the selection, design and arrangement of the component parts of the embodiments described herein without departing from the scope of the invention as represented in the following claims.

I claim:

1. A tool for planarizing a workpiece, the tool comprising a first cylindrical roller including a polishing material contactable with a surface of a workpiece, said first cylindrical roller being rotatable against a surface of a workpiece to planarize the workpiece, said polishing material being formed with grooves which segment said polishing material into individual processing members; and at least one additional roller spaced apart from said first cylindrical roller for further processing of a wafer, wherein rotation of said first cylindrical roller effects polishing and planarization of a surface of a wafer.

2. A tool as claimed in claim 1, wherein said at least one additional roller is a cleaning roller.

3. A tool as claimed in claim 2, wherein said workpiece is mounted on a platform and said rollers are mounted above said platform and are vertically movable to contact said workpiece, said tool further comprising a mechanism for translating said workpiece back and forth underneath said planarization roller and said cleaning roller.

4. A method for polishing or planarizing a semiconductor wafer, said wafer having multiple circuit dies formed thereon which are separated by elongated trenches, comprising the following steps:

(a) mounting a roller rotatable about a central axis such that it is movable to bear against a surface of said wafer and such that said central axis is not aligned with said elongated trenches formed in said wafer;

(b) moving said roller such that it bears against said surface of said wafer;

(c) rotating said roller such that it polishes or planarizes said surface of said wafer; and (d) translating said wafer back and forth as it is polished or planarized by said roller.

5. A method as claimed in claim 4, wherein said wafer is supported on a platform, and said roller is mounted above said platform and is moved vertically to bear against said wafer.

6. A method as claimed in claim 4, wherein said wafer is translated underneath said roller a discrete number of passes and is rotated a predetermined amount prior to each pass.

7. A method as claimed in claim 6, wherein said predetermined amount of said wafer rotations if added total an integer number of complete revolutions of said wafer.

8. A method as claimed in claim 4, wherein said roller has a length sufficient to polish or planarize a plurality of wafers simultaneously.

9. A method as claimed in claim 4, wherein said wafer is also translated underneath a cleaning roller which rotates against said wafer to clean said wafer.

10. A method as claimed in claim 9, wherein said wafer is also translated underneath a metrology station having measurement means for determining whether said wafer has been adequately polished or planarized.

11. A tool for performing multiple processing operations on a surface of a semiconductor wafer having elongated trenches formed thereon, the tool comprising first and second cylindrical rollers each rotatable about a central axis and each mounted to contact said wafer surface to perform first and second processing operations, the central axes of the rollers not aligned with said elongated trenches formed in a wafer;

wherein when a wafer is mounted on a platform of the tool, the trenched wafer surface faces upward, and at least one of said first and second cylindrical rollers is mounted above said platform such that said at least one of said first and second rollers is vertically movable to contact said wafer surface and rotatable to perform at least one of said first and second processing operations; and wherein said platform includes means for horizontally translating said wafer as said at least one roller performs said at least one processing operation.

12. A tool for performing multiple processing operations on a surface of a semiconductor wafer having elongated trenches formed thereon, said tool comprising first and second cylindrical rollers each rotatable about a central axis and each mounted to contact a wafer surface to perform first and second processing operations, the central axes not aligned with elongated trenches formed in the wafer to undergo processing, wherein said first roller polishes and planarizes a wafer surface, and a second roller cleans said wafer surface.

13. A tool for planarizing a workpiece having a plurality of dies formed thereon, the tool comprising a cylindrical roller including a polishing material contactable with a surface of a workpiece, said cylindrical roller being rotatable against a surface of a workpiece to planarize a workpiece, said polishing material being formed with grooves which segment said polishing material into individual processing members, wherein the grooves on said polishing material are spaced apart on the order of the size of an individual die.

14. A tool for planarizing a workpiece having a plurality of dies formed thereon, the tool comprising a cylindrical roller including a polishing material contactable with a surface of a workpiece, said cylindrical roller being rotatable against a surface of a workpiece to planarize a workpiece, said polishing material being formed with grooves which segment said polishing material into individual processing members, wherein the grooves on said polishing material are spaced apart such that each individual processing member will be in contact with only approximately 1 to 4 individual dies at a time.

15. A tool for planarizing a workpiece, the tool comprising a cylindrical roller including a polishing material contactable with a surface of a workpiece, said cylindrical roller being rotatable against a surface of a workpiece to planarize a workpiece, said polishing material being formed with grooves which segment said polishing material into individual processing members, wherein the grooves on said polishing material are spaced apart such that local nonuniformities on a workpiece will only affect individual processing members on said roller.

* * * * *